US012302987B2

(12) United States Patent
Nasu et al.

(10) Patent No.: US 12,302,987 B2
(45) Date of Patent: May 20, 2025

(54) SHOE INSOLE

(71) Applicant: NASYU CO., LTD., Owariasahi (JP)

(72) Inventors: Tomokazu Nasu, Owariasahi (JP); Keiichi Sakai, Owariasahi (JP); Naoji Sakai, Owariasahi (JP)

(73) Assignee: NASYU CO., LTD., Owariasahi (JP)

( * ) Notice: Subject to any disclaimer, the term of this patent is extended or adjusted under 35 U.S.C. 154(b) by 273 days.

(21) Appl. No.: 17/615,235

(22) PCT Filed: Aug. 5, 2019

(86) PCT No.: PCT/JP2019/030665
§ 371 (c)(1),
(2) Date: Nov. 30, 2021

(87) PCT Pub. No.: WO2021/024341
PCT Pub. Date: Feb. 11, 2021

(65) Prior Publication Data

US 2022/0225732 A1 Jul. 21, 2022

(51) Int. Cl.
*A43B 17/00* (2006.01)
*A43B 7/142* (2022.01)
(Continued)

(52) U.S. Cl.
CPC ..... *A43B 17/006* (2013.01); *A43B 7/1445* (2013.01); *A43B 7/142* (2013.01); *A43B 7/143* (2013.01)

(58) Field of Classification Search
CPC ..... A43B 7/1405; A43B 7/141; A43B 17/006; A43B 17/02; A43B 7/1415; A43B 7/143;
(Continued)

(56) References Cited

U.S. PATENT DOCUMENTS 3,084,695 A * 4/1963 O'Donnell ..... A43B 7/1445 36/174
4,760,655 A * 8/1988 Mauch ..... A43B 7/146 36/43

(Continued)

FOREIGN PATENT DOCUMENTS

AT 001863 U1 * 1/1998 ..... A43B 7/145
DE 19801301 A1 * 11/1998 ..... A43B 17/14

(Continued)

OTHER PUBLICATIONS

Translation of DE-19801301-A1 (Year: 1998).*

(Continued)

*Primary Examiner* — Khoa D Huynh
*Assistant Examiner* — Grady Alexander Nunnery
(74) *Attorney, Agent, or Firm* — Oliff PLC

(57) ABSTRACT

A shoe insole having a protruding portion for stimulating the plantar side of a foot, and both shoe insole surfaces are used. The insole contains: a flat plate-shaped base portion made of a flexible material; and a protruding portion from at least one of the first and second insole surfaces and stimulates the plantar side of a foot. The first and second insole surfaces stimulate the same portion of the right and left feet when a load is applied by the foot from the second surface where the insole is in one of right and left shoes with the first surface having the protruding portion in contact with the shoe mid-sole portion, and when a load is applied by the foot from the first surface where the shoe insole is placed in the other of right and left shoes with the second surface in contact with the mid sole portion.

10 Claims, 6 Drawing Sheets

(51) Int. Cl.
*A43B 7/143* (2022.01)
*A43B 7/1445* (2022.01)

(58) Field of Classification Search
CPC ..... A43B 7/142; A43B 7/1445; A43B 17/00; A43B 7/22; A43B 7/223; A43B 7/226; A43B 17/023; A43B 17/14; A43B 17/003; A43B 17/10
USPC ..... 36/178, 44, 43
See application file for complete search history.

(56) References Cited

U.S. PATENT DOCUMENTS

| | | | | |
|---|---|---|---|---|
| 2001/0039746 | A1 | 11/2001 | Seiter | |
| 2003/0140524 | A1 | 7/2003 | Robinson et al. | |
| 2005/0166425 | A1* | 8/2005 | Seiter | A43B 7/145 36/28 |
| 2006/0185197 | A1 | 8/2006 | Rhenter | |
| 2008/0034614 | A1* | 2/2008 | Fox | B32B 27/283 36/43 |
| 2013/0185955 | A1 | 7/2013 | Cheng | |
| 2018/0279718 | A1 | 10/2018 | Christensen et al. | |

FOREIGN PATENT DOCUMENTS

| | | | |
|---|---|---|---|
| FR | 2 858 525 | A1 | 2/2005 |
| JP | S64-83201 | A | 3/1989 |
| JP | 3003637 | U | 10/1994 |
| JP | 2002-272507 | A | 9/2002 |
| JP | 2003-245105 | A | 9/2003 |
| JP | 2009-160358 | A | 7/2009 |
| JP | 2010-000275 | A | 1/2010 |
| JP | 2011-239918 | A | 12/2011 |
| JP | 2014-132940 | A | 7/2014 |
| JP | 2017-108906 | A | 6/2017 |
| JP | 2019-237 | A | 1/2019 |

OTHER PUBLICATIONS

Translation of AT-001863-U1 (Year: 1998).*
Jun. 24, 2022 extended Search Report issued in European Patent Application No. 19940178.7.
Oct. 19, 2019 Search Report issued in International Patent Application No. PCT/JP2019/030665.

* cited by examiner

SHOE INSOLE

TECHNICAL FIELD

The present invention relates to a shoe insole, and more specifically to a shoe insole that is arranged and used in the shoe to stimulate the plantar side of the foot.

BACKGROUND ART

There are shoe insoles aiming to improve the environment inside the shoes through dehumidification, deodorization, antibacterial effects, and the like, and also shoe insoles aiming to support, strengthen, and stimulate the skeleton and muscles on the plantar side of the foot.

As disclosed in Patent Document 1, for example, the former shoe insoles for the purpose of improving the environment inside the shoes include shoe insoles made of a material having functionality such as moisture absorption, and shoe insoles whose portions contain functional sheets or capsules. Only a portion of such an insole needs to contain a functional material, and in general, its shape is a plate shape that is substantially flat overall.

On the other hand, as disclosed in Patent Documents 2, 3, for example, the latter shoe insoles for the purpose of supporting or stimulating the foot include insoles for improving comfortableness while the shoe is worn and activating the muscles of the foot by providing the insole surface (a surface that comes into contact with the foot) with a protrusion, an arch-shaped structure, a cup-shaped recessed portion for holding the heel portion, or the like. Such insoles exert their functions due to their surface structure, and have an uneven shape over their entire surfaces, such as a protruding portion or recessed portion being provided in a portion for supporting, strengthening, or stimulating the foot.

CITATION LIST

Patent Document

Patent Document 1: JP 2002-272507 A
Patent Document 2: JP 2010-000275 A
Patent Document 3: JP 2017-108906 A

SUMMARY OF INVENTION

Technical Problem

If a shoe insole has a substantially flat shape like the former shoe insoles do, the front surface and the back surface of the shoe insole can be switched and used. Colors and patterns of the shoe insoles can be selected according to the preference of users by providing different colors and patterns to their front surface and back surface, for example. Furthermore, such a shoe insole is advantageous in that it can be used for a long period of time by using other surface of the insole when one surface of the insole is damaged by usage, for example.

On the other hand, as described above, the front surfaces of shoe insoles for the purpose of supporting or stimulating the foot, for example, have elevations with an uneven structure, and in many cases, their back surfaces are usually made of a relatively hard material in order to maintain the uneven structure of the front surfaces, and have a flat shape extending along the mid sole portion of the shoe. A conventional shoe insole such as those disclosed in Patent Documents 2 and 3 is not intended to be used by inverting its front surface and back surface, and protruding portions and recessed portions are formed only in the front side surface and are not formed in the back surface. Therefore, if the front and back surfaces of the conventional shoe insole are inverted and used, because of this inversion, the functions of the protruding portions and the recessed portions may not be obtained or the uneven structure may collapse, and thus it is difficult to switch its front and back surfaces and use the conventional insole.

The present invention aims to provide a shoe insole whose front surface and back surface can both be used, the shoe insole having a protruding portion that can stimulate the plantar side of the foot.

Solution to Problem

A shoe insole according to the present invention for resolving the above-described issues contains a flat plate-shaped base portion made of a flexible material; and a protruding portion that protrudes from at least one of first surface and second surface of the insole and is configured to be able to stimulate the plantar side of a foot, in which the first surface and the second surface of the insole are configured to be able to stimulate the same portion of the right and left feet when a load is applied by the foot from the second surface in a state where the shoe insole is placed in one of right and left shoes with the first surface having the protruding portion being in contact with a mid sole portion of the shoe, and when a load is applied by the foot from the first surface in a state where the shoe insole is placed in the other of right and left shoes with the second surface being in contact with the mid sole portion of the shoe.

It is preferable that the shoe insole contains the protruding portion at least on the first surface; and the shoe insole does not comprise the protruding portion on the second surface, or contains the protruding portions on the first and second surfaces such that the height of the protruding portion on the second surface from the base portion is smaller than that of the protruding portion on the first surface.

It is preferable that the protruding portion includes a lateral metatarsal-bone protrusion configured to come into continuous contact with and across the plantar side of the foot from a center portion of the lateral longitudinal arch of the foot to the position over the heads of the metatarsal bones of the first and second toes. It is preferable that a rear lateral-longitudinal-arch protrusion is configured to come into contact with the position over the cuboid bone in the rear portion of the lateral longitudinal arch of the foot. It is preferable that the protruding portion does not have any portion configured to come into contact with a center portion of the medial longitudinal arch It is preferable that the shoe insole according to the present invention contains two outer layers and an interlayer placed between the two outer layers, and the interlayer forms the protruding portion on at least one of the two outer layers.

It is preferable that the interlayer has a plane-symmetrical shape in which a center plane in its thickness direction is a plane of symmetry.

It is preferable that the interlayer has a shape plane symmetrical about a center plane in its thickness direction.

It is preferable that the two outer layers have different thicknesses.

It is preferable to place and use the shoe insole according to the present invention underneath another insole.

Advantageous Effects of Invention

According to the present invention, it is possible to provide a shoe insole that can stimulate the plantar side of the foot by the protruding portion provided on at least one surface of the shoe insole, and can also stimulate the plantar side of the foot when its front surface and back surface are inverted and the other surface opposite to the surface having the protruding portion is brought into contact with the foot.

In the shoe insole according to the present invention, because the base portion is made of a flexible material, when a load is applied by the foot to the other surface (back surface) in a state where the surface (front surface) having the protruding portion is in contact with the mid sole portion of the shoe and the shoe insole is placed in the shoe, the base portion elastically deforms, and a portion provided with the protruding portion protrudes from the other surface. Accordingly, even if either the front surface or the back surface of the shoe insole is brought into contact with the mid sole portion of the shoe, the plantar side of the foot can be stimulated by the protruding portion. Therefore, by inverting the front surface and back surface and placing the insole in the opposite shoe, the one surface and the other surface can stimulate the same portion of the right and left feet. That is, if the shoe insole is placed in the right shoe and one surface of the shoe insole can stimulate the right foot, when the shoe insole is inverted and placed in the left shoe, the other surface can stimulate the left foot. When both surfaces of the shoe insole can be used, one surface and the other surface can have different colors and patterns, and the user can also select the surface to be used, according to his/her preference, for example. When one surface is damaged after being used, the shoe insole can be used for a long period of time by using the other surface. Furthermore, if the amount by which the protruding portion protrudes is changed between one surface and the other surface, the strength of stimulation can also be selected.

When one surface of the shoe insole has the protruding portion and the other surface has no protruding portion or is constituted by a substantially flat surface having a protruding portion whose height from the base portion is smaller than that of the protruding portion that protrudes from the one surface, it is possible to change the strength of stimulation to the plantar side of the foot between the front surface and the back surface of the insole, and to properly use them according to the purposes and preference. Because the base portion is made of a flexible material, if the shoe insole is placed in the shoe with the substantially flat surface being in contact with the plantar side of the foot, when a load is applied by the plantar side of the foot, the base portion deforms, and the portion provided with the protruding portion protrudes from the substantially flat surface, thus stimulating the plantar side of the foot. At this time, the amount by which the protruding portion protrudes is smaller than that when the shoe insole is used by bringing the side of the shoe insole provided with the protruding portion into contact with the plantar side of the foot. When the shoe insole is configured such that the amounts by which the protruding portions protrude from the front surface and the back surface are different from each other, it is possible to change the strength of stimulation to the plantar side of the foot between the front surface and the back surface, and to properly use them according to purposes. Furthermore, when the shoe insole is placed in the shoe such that one surface is a substantially flat surface and the substantially flat surface faces upward (the side where it comes into contact with the foot), it is possible to prevent the uneven structure of the shoe insole from being exposed when the shoe is taken off, and to easily print a pattern, logo, or the like on the substantially flat surface, thus improving its design.

The lateral metatarsal-bone protrusion, which comes into continuous contact with and across the plantar side of the foot from the center portion of the lateral longitudinal arch to the position over the heads of the metatarsal bones of the first and second toes, can support the arch structure on the plantar side of the foot from the front portion of the medial longitudinal arch to the lateral longitudinal arch, and can stimulate the mechanoreceptors in this portion. Accordingly, it is possible to facilitate the movement of the toes and strengthen the muscles of the toes.

The rear lateral-longitudinal-arch protrusion that comes into contact with the position over the cuboid bone in the rear portion of the lateral longitudinal arch of the foot can support the lateral longitudinal arch such that its front and rear portions are balanced, together with the lateral metatarsal-bone protrusion, support the cuboid bone, and activate the muscles of the entire plantar side of the foot. When the cuboid bone is supported, the movement of the fifth toe and the fourth toe located on the lateral side of the foot is activated, in particular, and thus it is possible to effectively use these toes when walking or during exercise.

The shoe insole may or need not include a portion that comes into contact with the center portion of the medial longitudinal arch as the protruding portion. The medial longitudinal arch has an arch structure that occupies a relatively large portion of the arch structure on the plantar side of the foot. When the shoe insole has a protruding portion that supports the center portion of the medial longitudinal arch, the area of the protruding portion in the entire shoe insole increases, and the effects of stimulation provided by the lateral metatarsal-bone protrusion, the rear lateral-longitudinal-arch protrusion, and the other protruding portions may not be obtained. Furthermore, if the area of the protruding portion that stimulates the plantar side of the foot is excessively large, the comfort while the shoe is worn may be impaired. Therefore, it is preferable not to provide the protruding portion in an excessively large area. From this point of view, it is preferable that the shoe insole according to the present invention does not have any protruding portion that comes into contact with the medial longitudinal arch. Also, as described above, when the shoe insole has the lateral metatarsal-bone protrusion and the rear lateral-longitudinal-arch protrusion, the muscles on the plantar side of the foot can be activated and its muscles can be strengthened, whereas when the medial longitudinal arch is supported, a load on the muscles on the plantar side of the foot is reduced. Therefore, it is preferable that the shoe insole does not have any protruding portion that comes into contact with the medial longitudinal arch. However, the lateral metatarsal-bone protrusion, the rear lateral-longitudinal-arch protrusion, and the other protruding portions may partially come into contact with the outer edge of the medial longitudinal arch.

The shoe insole according to the present invention contains the two outer layers and the interlayer placed between the two outer layers, and thus it is possible to easily form a structure provided with a protruding portion. Furthermore, a preferable surface can be easily selected by using outer layers having different colors or patterns as the two outer layers, for example.

Also, when outer layers made of different materials or having different thicknesses are used as the two outer layers, one surface may be a substantially flat surface having no protruding portion or only an excessively small protrusion in a state where no load is applied. When one surface is a substantially flat surface, it is possible to change the amounts by which the protruding portions protrude from the front surface and the back surface, to change the strength of stimulation to the plantar side of the foot between the front surface and the back surface, and to properly use them according to purposes. Furthermore, when the shoe insole is placed in the shoe such that one surface is a substantially flat surface and the substantially flat surface faces upward (the side where it comes into contact with the foot), it is possible to prevent the uneven structure of the shoe insole from being exposed from the front surface when the shoe is taken off, and to easily print a pattern, logo, or the like on the substantially flat surface, thus improving design of the shoe insole. When the amounts by which the protruding portions protrude from the front surface and the back surface are different from each other, it is especially preferable that the outer layers having different thicknesses are used as the two outer layers, because the amounts by which the protruding portions protrude can be easily adjusted.

On the other hand, when the front surface and the back surface are inverted, both the front surface and the back surface can provide the same degree of stimulation to the plantar side of the foot by forming the interlayer in a plane-symmetrical shape in which the center plane in its thickness direction is a plane of symmetry. Furthermore, if the interlayer has flat opposing surfaces and the flat surfaces are respectively in contact with the two outer layers, when either the front surface or the back surface of the shoe insole faces downward (the mid sole side of the shoe), one of the flat surfaces comes into contact with the mid sole portion of the shoe via the outer layer, and the protruding portion can be easily stabilized.

From the viewpoint of improving the feeling of a front surface of the shoe insole that comes into direct contact with the foot while the shoe is worn, for example, materials with a good skin feeling or materials with good design are often used. According to the present invention, both the front surface and the back surface of the shoe insole can be used. However, if a material with a good skin feeling or the like is used for both surfaces, costs may increase. By using a relatively inexpensive material for the shoe insole according to the present invention and placing and using the shoe insole underneath another insole, it is possible to suppress an increase in costs without impairing the comfort while the shoe is worn and impairing design. If the shoe insole according to the present invention is placed and used underneath another insole, the protruding portion preferably protrudes such that the plantar side of the foot can be sufficiently stimulated.

BRIEF DESCRIPTION OF DRAWINGS

FIG. 6 is a schematic view showing a use example of the shoe insole according to the second embodiment.

DESCRIPTION OF EMBODIMENTS

Figure 1C:
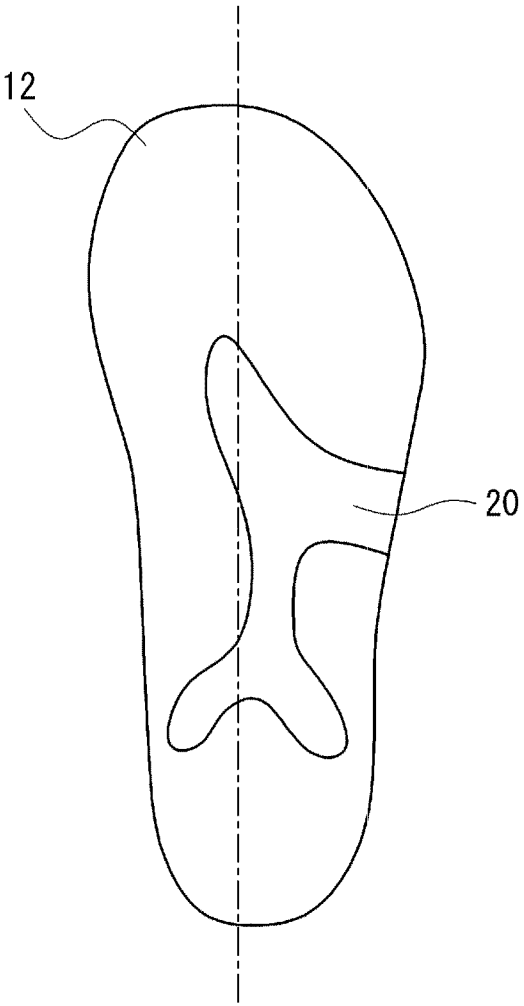
FIG. 1C is a diagram showing an external appearance of the shoe insole on its back surface side.
Figure 1B:
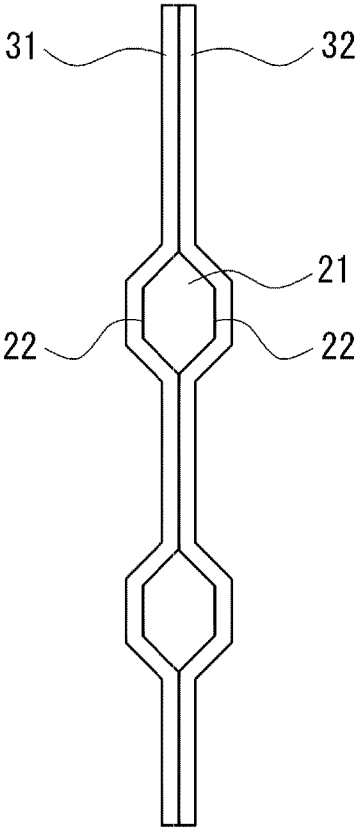
FIG. 1B is a cross-sectional view taken along A-A.
Figure 1A:
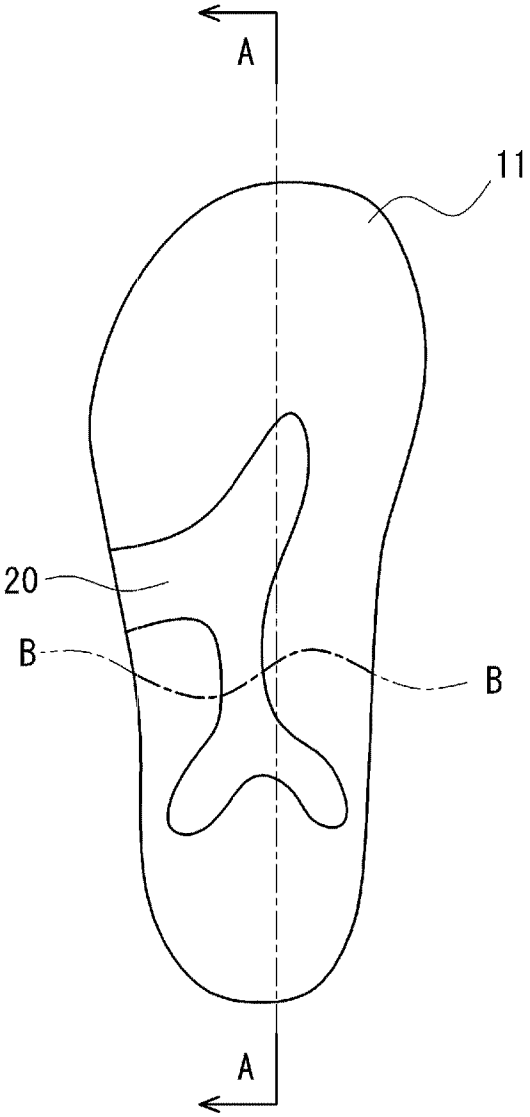
FIG. 1A is a diagram showing an external appearance of a shoe insole on its front surface side according to a first embodiment of the present invention.
Figure 2:
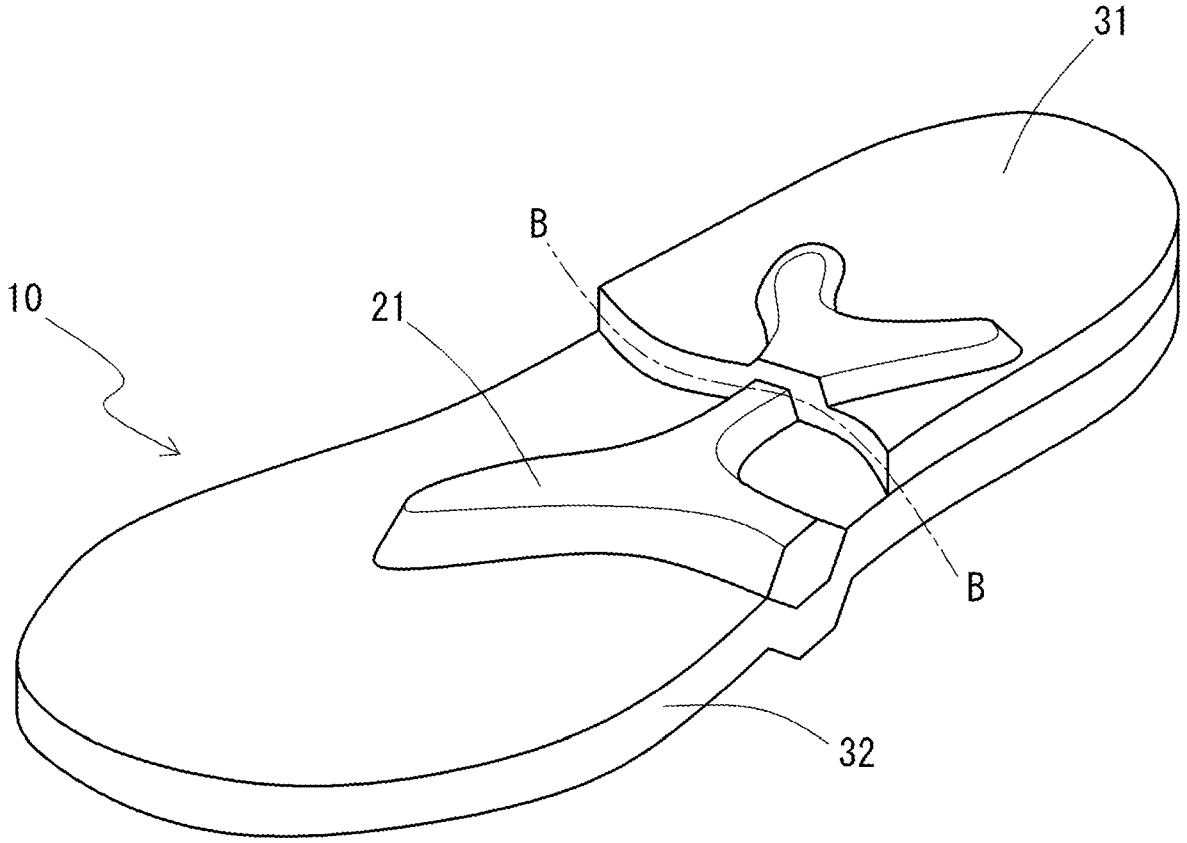
FIG. 2 is a perspective view showing the external appearance of the shoe insole shown in FIG. 1. The toe side of a first outer layer from the curved line B-B frontward is omitted to show the layered structure of the shoe insole.

A shoe insole according to the present invention will be described in detail with reference to the drawings. FIG. 1A is a diagram showing an external appearance of a shoe insole 10 on its front surface side according to a first embodiment, FIG. 1B is a cross-sectional view taken along A-A, and FIG. 1C is a diagram showing an external appearance of the shoe insole 10 on its back surface side. FIG. 2 is a perspective view showing the external appearance of the shoe insole 10. The toe side of a first outer layer 31 from the curved line B-B frontward is not shown in FIG. 2 to show the layered structure of the shoe insole 10. In this specification, surfaces of the shoe insole are identified as a front surface and a back surface or a first surface and a second surface for convenience. However, both surfaces of the shoe insole according to the present invention can be used, and there is no need to distinguish between these surfaces by making them to correspond to the front and back surfaces when the shoe insole is used.

The shoe insole 10 according to this embodiment is formed by layering two outer layers 31 and 32 and an interlayer 21, and includes protruding portions 20 formed by the interlayer 21 on a first surface 11 and a second surface 12. The first outer layer 31 and the second outer layer 32 extend along a contour of a mid sole portion of the shoe, and have a shape such that the insole can be placed in the right shoe or the left shoe by inverting the front surface and the back surface. The protruding portions 20 protruding from the respective first surface 11 and the second surface 12 reflect the shape of the interlayer 21, and the first surface 11 and the second surface 12 have the protruding portions 20 at positions where they can stimulate the same portion of the right and left feet. That is, if the left foot can be stimulated when the shoe insole 10 is placed in the left shoe such that the first surface 11 faces upward (the side where it comes into contact with the foot), when the shoe insole 10 is inverted and placed in the right shoe such that the second surface 12 faces upward (the side where it comes into contact with the foot), it is possible to stimulate the same portion of the right foot. A portion where the first outer layer 31 and the second outer layer 32 are directly layered without the interlayer serves as a flat base portion 30 that has no protruding portion 20.

The first outer layer 31 and the second outer layer 32 are made of a flexible material, and are plate-shaped members having the shape of the mid sole of the shoe. Rubber, polyurethane, EVA, polyethylene, soft vinyl chloride, leather, nonwoven fabric, woven fabric, or the like are preferable as a flexible material, for example. The rubber, polyurethane, EVA, polyethylene, or soft vinyl chloride may also be provided as foamed materials containing bubbles. It is preferable that the first outer layer 31 and the second outer layer 32 each have a thickness of 0.1 to 1.5 mm. When the thickness of the outer layers 31 and 32 is at least 0.1 mm, the insole has high durability. When the thickness of these layers is not more than 1.5 mm, the protruding portion 20 can be easily formed reflecting the shape of the interlayer 21, and it is possible to prevent the insole from being too thick. The first outer layer 31 and the second outer layer 32 may be made of the same material and have the same thickness, or may be made of different materials and have different thicknesses.

The interlayer 21 forms a protruding portion 20 that can stimulate the plantar side of the foot on at least one of the first surface 11 and the second surface 12. There is no particular limitation regarding the material forming the interlayer 21, and the interlayer 21 is preferably made of a flexible material, from the viewpoint that it can conform to the shape of the mid sole portion of the shoe. Examples of the flexible material include rubber, polyurethane, EVA, polyethylene, and soft vinyl chloride. From the viewpoint of sufficiently reflecting the shape of the interlayer 21 on the outer layers 31 and 32, the interlayer 21 is preferably thicker than at least the first outer layer 31 and the second outer layer 32. The thickness range is preferably 1.0 to 4.0 mm. When the thickness of the interlayer 21 is at least 1.0 mm, the plantar side of the foot can be sufficiently stimulated by the formed protruding portion 20. When the thickness of the interlayer 21 is not more than 4.0 mm, it is possible to prevent the entire insole from being too thick. It is preferable that the flexible material forming the interlayer 21 has higher elastic modulus than the flexible material forming the outer layers 31 and 32.

Figure 4A:
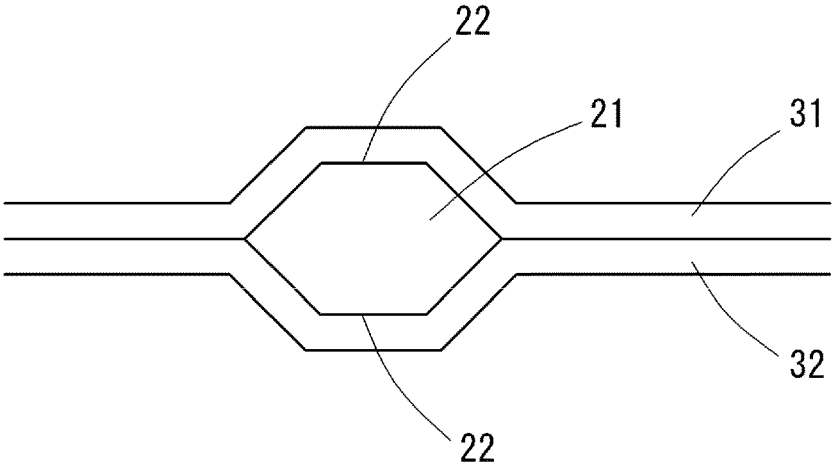
FIG. 4 is a cross-sectional view showing the cross-sectional shape of an interlayer.
Figure 4B:
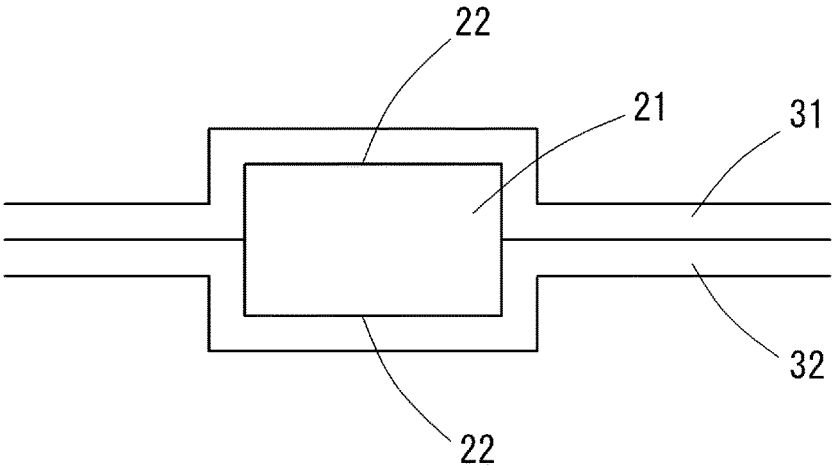
Figure 4C:
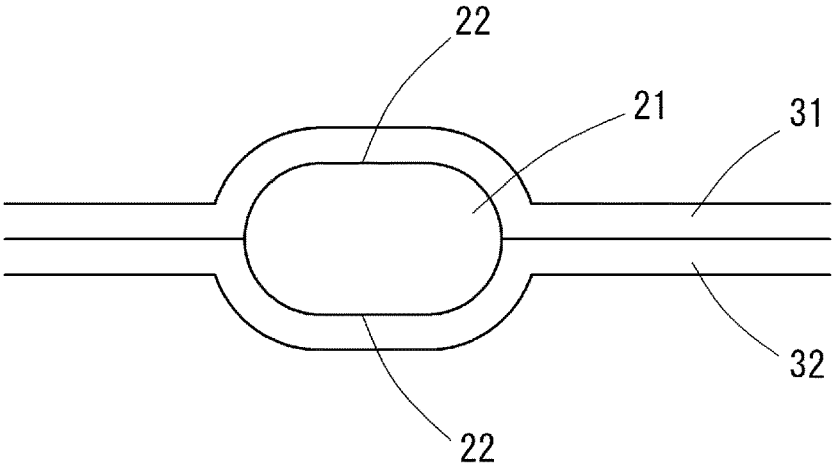

The interlayer 21 has a plane-symmetrical shape in which the center plane in its thickness direction is the plane of symmetry, and has flat opposing surfaces 22, which are respectively in contact with the outer layers 31 and 32. It is preferable that the cross-sectional shape of the interlayer 21 is a flat shape such as a hexagonal shape as shown in FIG. 4A, a rectangular shape as shown in FIG. 4B, or an oval shape as shown in FIG. 4C. When the interlayer 21 has such a cross-sectional shape, the interlayer 21 has a plane-symmetrical shape in which the center plane in its thickness direction is the plane of symmetry. Thus, when the first surface 11 and the second surface 12 of the shoe insole 10 are inverted, it is possible to stimulate the same corresponding portions of the right and left feet, and both the first surface 11 and the second surface 12 can provide the same degree of stimulation to the plantar side of the feet. Furthermore, the flat surface 22 is in contact with the mid sole portion of the shoe via the outer layer 31 or 32, and the protruding portions 20 are stabilized.

Figure 3:
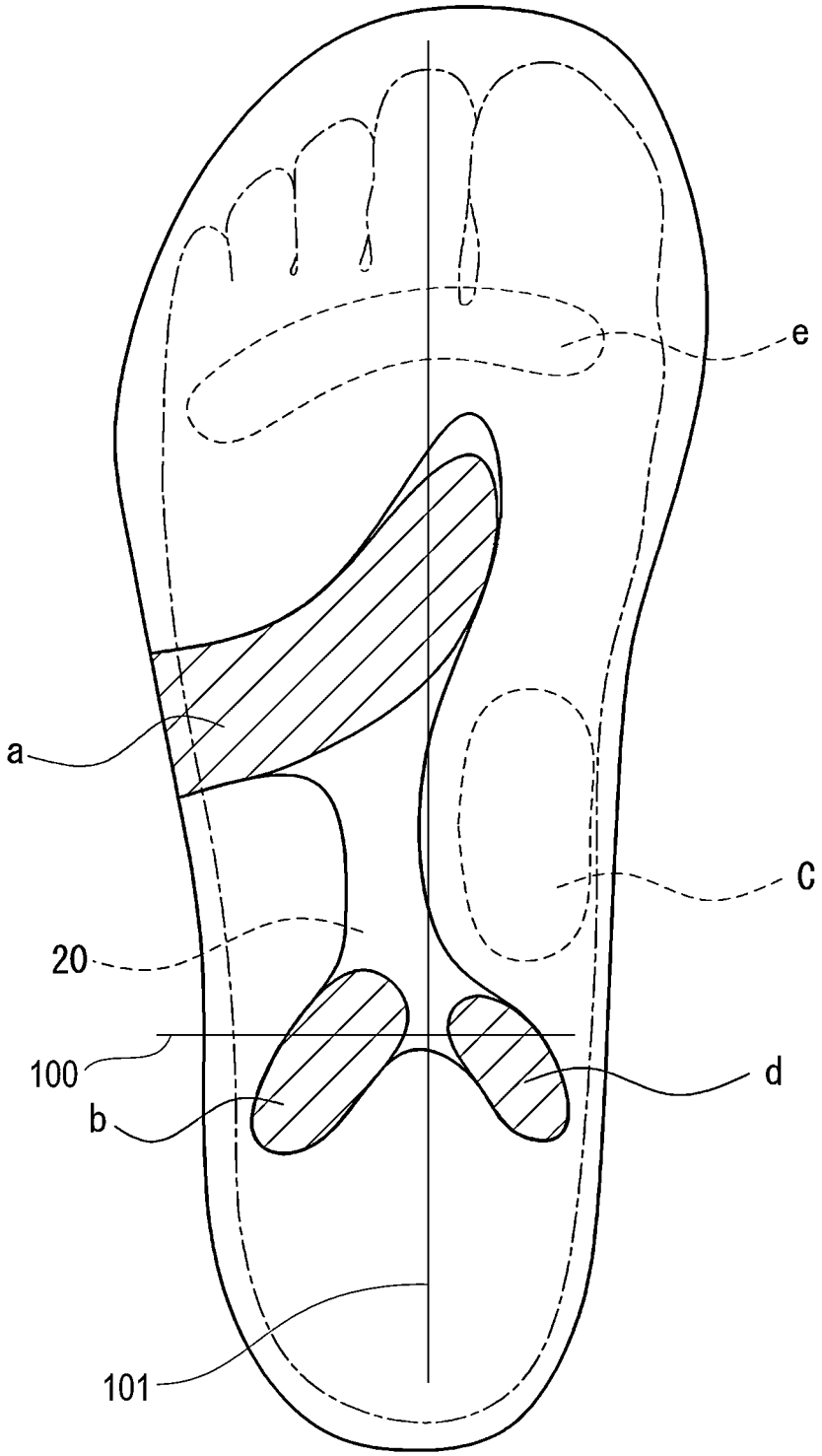
FIG. 3 is a diagram showing the position of a protruding portion of the shoe insole shown in FIG. 1 on the plantar side of the foot.

FIG. 3 is a diagram showing the position of the protruding portion 20 and the relationship between the protruding portion 20 and the plantar side of the foot. It is preferable that the protruding portion 20 includes at least a lateral metatarsal-bone protrusion a that is in continuous contact with and across the plantar side of the foot from the center portion of the lateral longitudinal arch to a position over the heads of the metatarsal bones of the first and second toes, and a rear lateral-longitudinal-arch protrusion b that comes into contact with the position of the cuboid bone of a rear portion of the lateral longitudinal arch of the foot.

The lateral metatarsal-bone protrusion a, which is in continuous contact with the plantar side of the foot and across the plantar side of the foot from the center portion of the lateral longitudinal arch to a position over the heads of the metatarsal bones of the first and second toes, can support the arch structure on the plantar side of the foot from a leading portion of the medial longitudinal arch to the lateral longitudinal arch, and can stimulate the mechanoreceptors in this portion. Accordingly, it is possible to facilitate the movement of the toes and strengthen the muscles of the toes.

The rear lateral-longitudinal-arch protrusion b that comes into contact with the position of the cuboid bone of the rear portion of the lateral longitudinal arch can support the lateral longitudinal arch such that its front and rear portions are balanced, together with the lateral metatarsal-bone protrusion a, support the cuboid bone, and activate the muscles of the entire plantar side of the foot. When the cuboid bone is supported, the movement of the fifth toe and the fourth toe located on the lateral side of the foot is especially activated, and it is possible to effectively use these toes when walking or during exercise.

In addition to the lateral metatarsal-bone protrusion a and the rear lateral-longitudinal-arch protrusion b, the protruding portion 20 preferably has a medial heel-anterior protrusion d that is located at the medial longitudinal arch rear portion and comes into contact with the anterior medial side of the heel, for example. When the medial heel-anterior protrusion d is provided, it is possible to hold the heel from left and right together with the rear lateral-longitudinal-arch protrusion b, and to prevent the foot from shifting in the left-right direction when it lands on the ground. This makes it possible to suppress shifting in the relative position between the protrusions and the plantar side of the foot, and to effectively exert the effects of the protrusions. The medial heel-anterior protrusion d overlaps the rear lateral-longitudinal-arch protrusion b along a first line 100 transverse to a second line 101 that connects a toe side to a heel side of the shoe insole 10.

The protruding portion 20 may also have a portion c that comes into contact with the center portion of the medial longitudinal arch. However, it is preferable that the shoe insole 10 according to this embodiment does not have any protruding portion c that comes into contact with the center portion of the medial longitudinal arch. The medial longitudinal arch has an arch structure that occupies a relatively large portion of the arch structure on the plantar side of the foot. If the shoe insole has a protruding portion c that supports the center portion of the medial longitudinal arch, the area of the protruding portion 20 with respect to the entire shoe insole 10 increases, and the effects of stimulation provided by the lateral metatarsal-bone protrusion a, the rear lateral-longitudinal-arch protrusion b, and the other protrusions may not be obtained. Furthermore, if the area of the protruding portion 20 that stimulates the plantar side of the foot is increased too much, the comfort of wearing the shoe may be impaired. Therefore, it is preferable not to provide the protruding portion 20 in an excessively large area. The shoe insole 10 according to this embodiment does not have the protruding portion c that comes into contact with the center portion of the medial longitudinal arch. However, the lateral metatarsal-bone protrusion a, the rear lateral-longitudinal-arch protrusion b, and the other protrusions may partially come into contact with the outer edge of the medial longitudinal arch.

Furthermore, when the shoe insole has an arch-shaped protruding portion c that supports the center portion of the medial longitudinal arch, it is possible to reduce the load on the plantar side of the foot. However, the muscles forming the arch structure of the foot may weaken. The lateral metatarsal-bone protrusion a and the rear lateral-longitudinal-arch protrusion b can activate the muscles of the foot and improve the function of the foot through stimulation of the plantar side of the foot. From the viewpoint that such a shoe insole 10 effectively improves the function of the foot by the lateral metatarsal-bone protrusion a and the rear lateral-longitudinal-arch protrusion b, it is preferable that the shoe insole 10 does not have a configuration for reducing the load on the foot, such as the protruding portion c that comes into contact with the center portion of the medial longitudinal arch.

Furthermore, shoe insoles often include a so-called toe pillow e filling the space below the phalanges of the toes anterior to the heads of the metatarsal bones. However, it is preferable not to provide the toe pillow e in this embodiment, from the viewpoint of achieving the activation of the movement of the toes by the lateral metatarsal-bone protrusion a and the rear lateral-longitudinal-arch protrusion b.

The shoe insole 10 according to this embodiment has the lateral metatarsal-bone protrusion a, the rear lateral-longitudinal-arch protrusion b, and the medial heel-anterior protrusion d, and does not have the arch-shaped protrusion c supporting the center portion of the medial longitudinal arch or the toe pillow e. If the shoe insole 10 has such shapes of protruding portions, it is particularly effective in strengthening the muscles on the plantar side of the foot, and is suitable for improving physical athletic ability, specifically walking ability, such as improving the performance of athletes.

The interlayer 21 may be constituted by a plurality of components, such as a form in which the positions where the protrusions a, b, and d are formed are separate from each other. However, it is preferable that the protrusions a, b, and d are formed as a single body, from the viewpoint of efficiently positioning the outer layers 31 and 32 and the interlayer 21 when layering them. In this case, the thickness of the interlayer 21 formed as a single body may be partly reduced or increased. For example, a portion that needs to stimulate the plantar side of the foot may be thickened by increasing the thickness of the interlayer 21, or a portion that does not need to stimulate the plantar side of the foot and a portion constituting the base portion may be thinned by reducing the thickness of the interlayer 21.

The outer layers 31 and 32 and the interlayer 21 may be made of a resin material, rubber material, or the like using a mold, or may also be formed by cutting a flexible material in the form of a large area sheet shape into a desired shape, for example. The shoe insole 10 can be formed by layering the second outer layer 32, the interlayer 21, and the first outer layer 31 in the stated order, and bonding them together using an adhesive or through welding. If the first surface 11 and the second surface 12 are not distinguished, two identical shoe insoles 10 may be used as one pair of shoe insoles, using the first outer layer 31 and the second outer layer 32 made of the same material and having the same thickness, and the resulting pair of shoe insoles may be used as one pair of shoe insoles. If the first surface 11 and the second surface 12 are distinguished by providing different colors to the first outer layer 31 and the second outer layer 32, for example, it is possible to produce the right shoe insole and the left shoe insole separately by changing the order of layering the first outer layer 31 and the second outer layer 32, thus making a pair of right and left insoles.

When the first outer layer 31 and the second outer layer 32 made of the same material and having the same thickness are used, as in the first embodiment, the resulting shoe insole has the protruding portions 20 that respectively protrude from the first surface 11 and the second surface 12 to the same extent. The first surface 11 and the second surface 12 of such a shoe insole need not be distinguished, and if one surface is damaged, for example, the other surface can be used and the shoe insole can be used for a long period of time. Furthermore, it is also possible to use a first outer layer 31 and a second outer layer 32 having different colors or different patterns, and to select the surface to be used, according to the preference of the users. In the first embodiment in which the protruding portions 20 protrude from the first surface 11 and the second surface 12, the first surface 11 or the second surface 12 is brought into contact with the mid sole portion, and the shoe insole 10 is placed in a shoe. When a load is applied from above, the base portion 30 elastically deforms, the amount by which the protruding portion 20 that comes into contact with the plantar side of the foot protrudes increases, and the plantar side of the foot is stimulated.

Figure 5A:
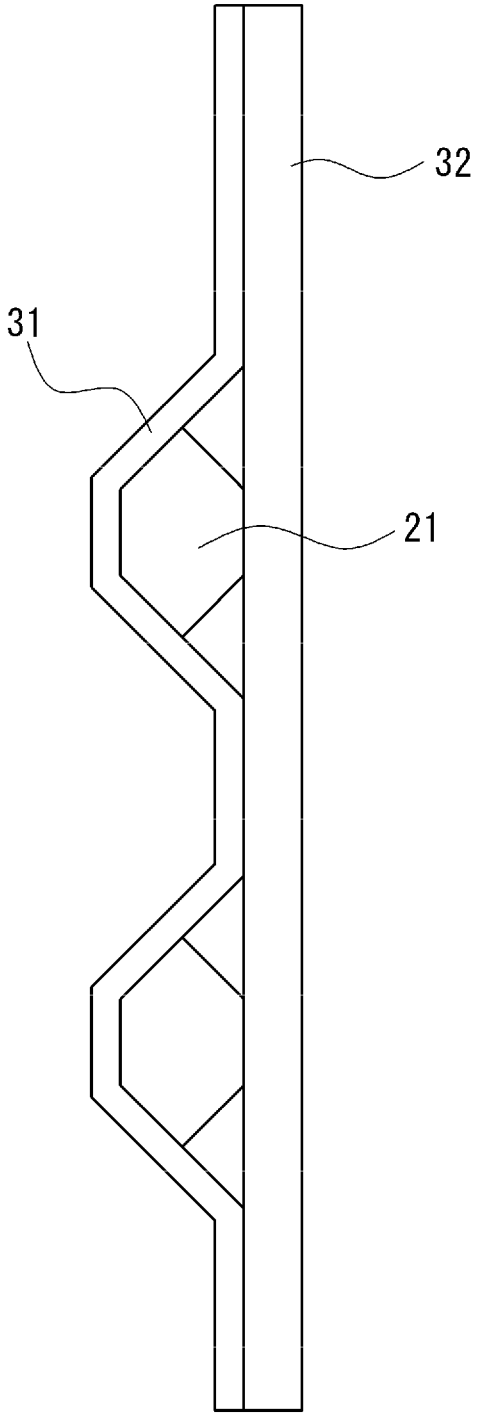
FIG. 5A is a diagram showing a cross-section of a shoe insole according to a second embodiment.

On the other hand, it is also possible to use a first outer layer 31 and a second outer layer 32 that are made of different materials or different thicknesses. When a first outer layer 31 and a second outer layer 32 having different thicknesses are used, as in the second embodiment shown in FIG. 5A, for example, the surface (second surface 12) of the outer layer (the second outer layer 32) that is less prone to deformation is formed as a substantially flat surface having no protruding portion 20 or only an excessively small protrusion.

Figure 6A:
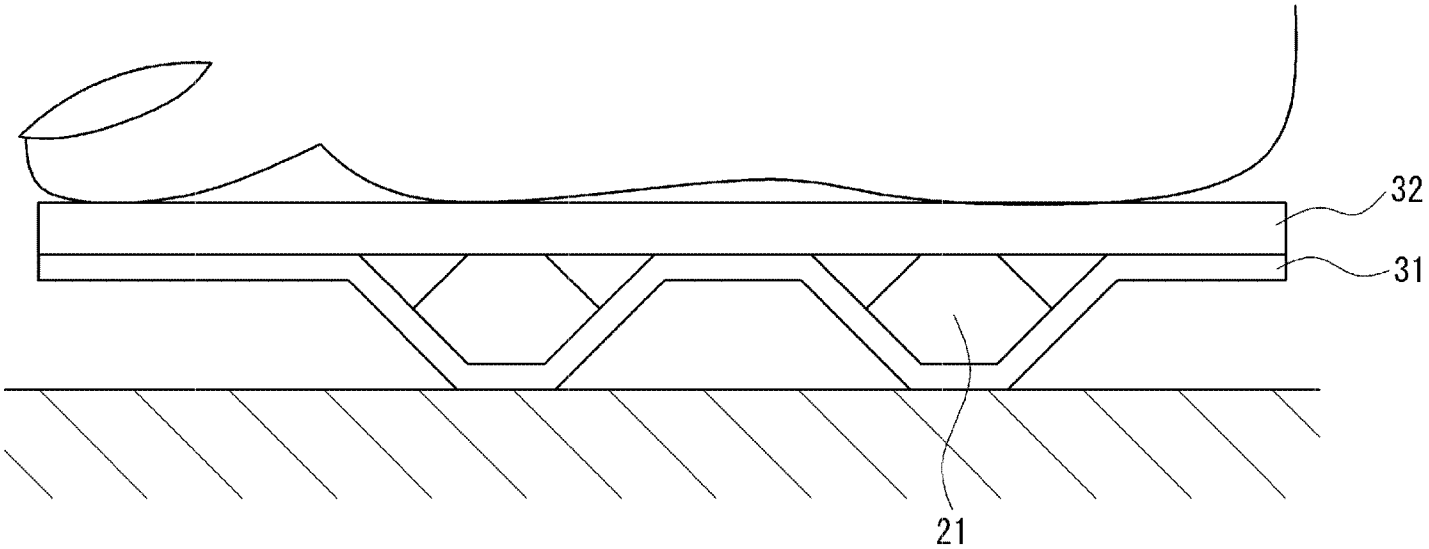
FIG. 6A is a schematic view showing a state where no load is applied to the shoe insole.
Figure 6B:
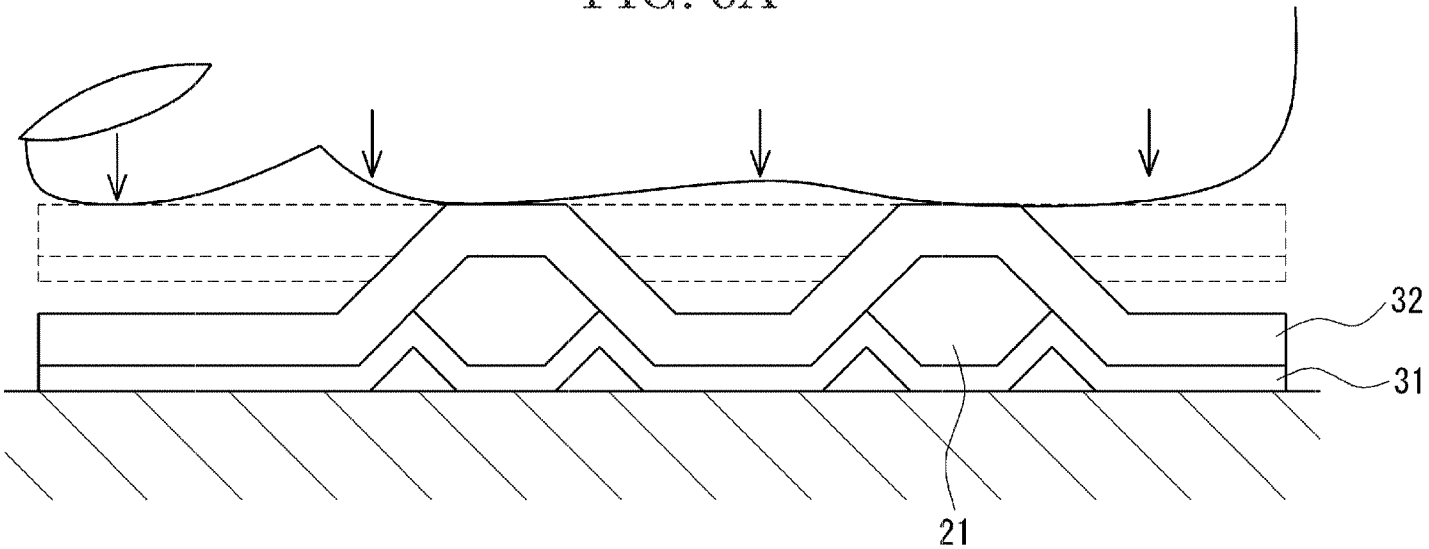
FIG. 6B is a schematic view showing deformation of the shoe insole when a load is applied to the shoe insole.

In a shoe insole having a protruding portion 20 that protrudes only from one surface by a large amount, when the first surface 11 having the protruding portion 20 is brought into contact with the mid sole portion of the shoe and the shoe insole is placed in the shoe, a substantially flat second surface 12 faces upward (the side where it comes into contact with the foot) as shown in FIG. 6A. With this state, when the shoe is worn on the foot and a load is applied from the second surface 12 side, the base portion 30 made of a flexible material deforms, and a portion forming the protruding portion 20 protrudes from the second surface 12 as shown in FIG. 6B and can stimulate the plantar side of the foot. In this case, the second surface 12 stimulates the plantar side of the foot via the outer layer (the second outer layer 32) that is less prone to deformation. Therefore, the stimulation to the plantar side of the foot is weaker than direct stimulation to the plantar side of the foot provided by the first surface 11 when the shoe insole is arranged with the first surface 11 facing upward.

When a first outer layer 31 and a second outer layer 32 made of different materials or having different thicknesses are used and the amounts by which the protruding portions protrude from the first surface 11 and the second surface 12 are different from each other, it is possible to select a surface to be used, according to a desired strength of stimulation to the plantar side of the foot, the purpose of use such as use of the shoe insole 10 arranged underneath another insole or use of the shoe insole 10 that is in direct contact with the plantar side of the foot, or the like. Furthermore, when one surface is a substantially flat surface and the shoe insole is placed in the shoe such that the substantially flat surface faces upward (the side where it comes into contact with the foot), it is possible to prevent the uneven structure of the shoe insole from being exposed from its surface when the shoe is taken off, and a pattern or logo can also be easily printed on the substantially flat surface, resulting in good design.

As a method for changing the amounts by which the protruding portions protrude from the first surface 11 and the second surface 12, it is possible to use, for the first outer layer 31 and the second outer layer 32, different raw materials having different properties or foaming ratios, to use raw materials having different thickness, or to also form the interlayer 21 into a shape that is asymmetrical in its thickness direction, for example. When the first outer layer 31 and the second outer layer 32 having different thicknesses are used for the first surface 11 and the second surface 12, the amounts by which the protruding portions 20 protrude from the first surface 11 and the second surface 12 can be easily adjusted, thus improving productivity. In this case, the thickness of the thinner layer and the thickness of the thicker layer preferably have a ratio of 2:3 to 1:2. When the above-mentioned ratio is within the above-described range, it is possible to sufficiently change the amounts by which the protruding portions protrude from the surfaces, and to form a protruding portion such that the plantar side of the foot can be sufficiently stimulated regardless of the surface that is in contact with the plantar side of the foot.

Figure 5B:
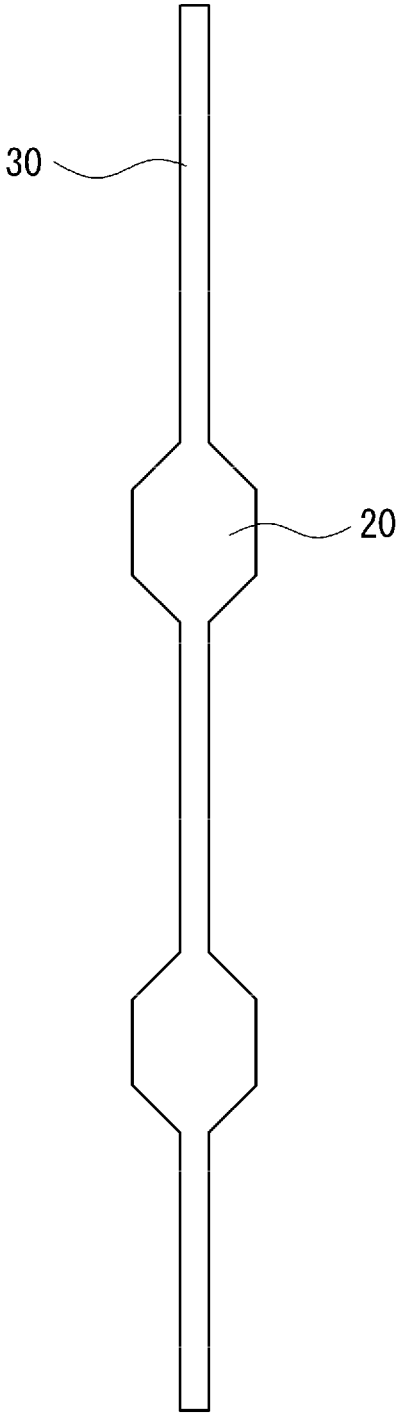
FIG. 5B is a diagram showing a cross-section of a shoe insole according to a third embodiment.

Although the shoe insole 10 having a layered structure composed of the outer layers 31 and 32 and the interlayer 21 has been described above, the shoe insole 10 need not have a layered structure. As in a third embodiment shown in FIG. 5B, the shoe insole 10 may also have a single-layer structure in which these layers are formed as a single body, for example. The shoe insole 10 having such a structure can be formed using a mold having surfaces provided with grooves corresponding to the protruding portions 20, for example.

The shoe insole 10 can also be placed and used underneath another insole. A material with a good skin feeling or a material with good design is often used for the surface of the shoe insole that comes into direct contact with the foot, from the viewpoint of improving the comfort while the shoe is worn, for example. The shoe insole 10 according to this embodiment, both the first surface 11 and the second surface 12 can be used. However, if a material with a good skin feeling or the like is used for both surfaces, costs may increase. By using a relatively inexpensive material for the first outer layer 31 and the second outer layer 32 and placing and using the shoe insole underneath another insole, it is possible to suppress an increase in costs without impairing design or the comfort while the shoe is worn. If the shoe insole according to the present invention is placed and used underneath another insole, it is preferable that a protruding portion protrudes such that the plantar side of the foot can be sufficiently stimulated.

Although an embodiment of the present invention has been described in detail above, the present invention is not limited to the above-described embodiment, and various modifications can be made without departing from the gist of the present invention. A portion of the shoe insole may also be provided with a layer having functionality such as dehumidification, deodorization, or antibacterial effects, for example. Furthermore, the shoe insole according to the present invention need not extend over the entire area of the foot, and may also be a so-called half-insole for only the heel side or the toe side.

The invention claimed is:

1. A shoe insole comprising:

a flat plate-shaped base portion made of a flexible material; and a protruding portion that protrudes from the base portion on at least one of a first surface and a second surface of the insole and is configured to be able to stimulate the plantar side of a foot, wherein the shoe insole comprises:

two outer layers having different thicknesses; and an interlayer placed between the two outer layers, the interlayer has a shape that is plane symmetrical about a center plane in its thickness direction, and forms the protruding portion on at least one of the first surface and the second surface, the protruding portion is configured to come into contact with one or more arches of a left foot when the shoe insole is placed in a left shoe and to come into contact with one or more arches of a right foot when the shoe insole is placed in a right shoe on the plantar side of the foot, and to be able to support the arches, the first surface and the second surface of the insole are configured to be able to stimulate the same portion of the right and left feet when a load is applied by the foot from the second surface in a state where the shoe insole is placed in one of the right shoe and the left shoe with the first surface having the protruding portion being in contact with a mid sole portion of the one of the right shoe and the left shoe, and when a load is applied by the foot from the first surface in a state where the shoe insole is placed in the other of the right shoe and the left shoe with the second surface being in contact with the mid sole portion of the other of the right shoe and the left shoe, the protruding portion includes three protrusions, namely, a lateral metatarsal-bone protrusion configured to come into continuous contact with and across the plantar side of the foot from a center portion of the lateral longitudinal arch of the foot to the position over the heads of the metatarsal bones of the first and second toes, a rear lateral-longitudinal-arch protrusion configured to come into contact with the position over the cuboid bone in the rear portion of the lateral longitudinal arch of the foot, and a medial heel-anterior protrusion configured to come into contact with the anterior medial side of the heel, in the interlayer, the three protrusions are formed as a single body, and portions for stimulating the plantar side of the foot, including the three protrusions, are thicker, whereas portions that are not for stimulating the plantar side of the foot and a portion constituting the base portion are thinner, the two outer layers and the interlayer are bonded to each other by an adhesive or through welding, the medial heel-anterior protrusion is configured to hold the heel from the left and right together with the rear lateral-longitudinal-arch protrusion, and the lateral metatarsal-bone protrusion is entirely in front of the rear lateral-longitudinal-arch protrusion and the medial heel-anterior protrusion.

2. The shoe insole according to claim 1, wherein the shoe insole comprises the protruding portion at least on the first surface; and the shoe insole does not comprise the protruding portion on the second surface, or comprises the protruding portion on the first and second surfaces such that the height of the protruding portion on the second surface from the base portion is smaller than that of the protruding portion on the first surface.

3. The shoe insole according to claim 1, wherein the rear lateral-longitudinal-arch protrusion does not reach a rear end of the shoe insole.

4. The shoe insole according to claim 1, wherein the protruding portion does not have any portion configured to come into contact with a center portion of the medial longitudinal arch.

5. The shoe insole according to claim 1, wherein the interlayer has opposing flat surfaces, and the flat surfaces are in contact with the two outer layers respectively.

6. The shoe insole according to claim 1, wherein the shoe insole is able to be placed and used underneath another insole.

7. The shoe insole according to claim 1, wherein the shoe insole does not have a protruding portion configured to be placed below the phalanges of the toes anterior to the heads of the metatarsal bones when both the foot and the shoe insole are placed in either the left shoe or the right shoe.

8. The shoe insole according to claim 1, wherein the two outer layers each have a thickness of 0.1 to 1.5 mm, and the interlayer has a thickness of 1.0 to 4.0 mm.

9. The shoe insole according to claim 1, wherein the medial heel-anterior protrusion overlaps the rear lateral-longitudinal-arch protrusion along a first line transverse to a second line that connects a toe side to a heel side of the shoe insole.

10. A shoe insole comprising:

a flat plate-shaped base portion made of a flexible material; and a protruding portion that protrudes from the base portion on at least one of a first surface and a second surface of the insole and is configured to be able to stimulate the plantar side of a foot, wherein the shoe insole comprises:

two outer layers having different thicknesses; and an interlayer placed between the two outer layers, the interlayer has a shape that is plane symmetrical about a center plane in its thickness direction, and forms the protruding portion on at least one of the first surface and the second surface, the protruding portion is configured to come into contact with one or more arches of a left foot when the shoe insole is placed in a left shoe and to come into contact with one or more arches of a right foot when the shoe insole is placed in a right shoe on the plantar side of the foot, and to be able to support the arches, the first surface and the second surface of the insole are configured to be able to stimulate the same portion of the right and left feet when a load is applied by the foot from the second surface in a state where the shoe insole is placed in one of the right shoe and the left shoe with the first surface having the protruding portion being in contact with a mid sole portion of the one of the right shoe and the left shoe, and when a load is applied by the foot from the first surface in a state where the shoe insole is placed in the other of the right shoe and the left shoe with the second surface being in contact with the mid sole portion of the other of the right shoe and the left shoe, the protruding portion includes three protrusions, namely, a lateral metatarsal-bone protrusion configured to come into continuous contact with and across the plantar side of the foot from a center portion of the lateral longitudinal arch of the foot to the position over the heads of the metatarsal bones of the first and second toes, a rear lateral-longitudinal-arch protrusion configured to come into contact with the position over the cuboid bone in the rear portion of the lateral longitudinal arch of the foot, and a medial heel-anterior protrusion configured to come into contact with the anterior medial side of the heel, in the interlayer, the three protrusions are formed as a single body, and portions for stimulating the plantar side of the foot, including the three protrusions, are thicker, whereas portions that are not for stimulating the plantar side of the foot and a portion constituting the base portion are thinner, the two outer layers and the interlayer are bonded to each other by an adhesive or through welding, the medial heel-anterior protrusion is configured to hold the heel from the left and right together with the rear lateral-longitudinal-arch protrusion, and the medial heel-anterior protrusion extends more toward a medial side of the shoe insole than the lateral metatarsal-bone protrusion.

* * * * *